US006742883B1

(12) United States Patent
Takata

(10) Patent No.: US 6,742,883 B1
(45) Date of Patent: Jun. 1, 2004

(54) INK JET HEAD CAPABLE OF RELIABLY REMOVING AIR BUBBLES FROM INK

(75) Inventor: Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/640,863

(22) Filed: Aug. 18, 2000

Related U.S. Application Data

(63) Continuation-in-part of application No. 09/049,046, filed on Mar. 27, 1998, now Pat. No. 6,270,205.

(30) Foreign Application Priority Data

| | | |
|---|---|---|
| Mar. 28, 1997 | (JP) | 9-077257 |
| Mar. 31, 1997 | (JP) | 9-079601 |
| Mar. 31, 1997 | (JP) | 9-079602 |
| Aug. 20, 1999 | (JP) | 11-234179 |
| Jul. 12, 2000 | (JP) | 2000-211226 |

(51) Int. Cl.[7] ..... B41J 2/19
(52) U.S. Cl. ..... 347/92
(58) Field of Search ..... 347/85, 86, 87, 347/69, 63, 71

(56) References Cited

U.S. PATENT DOCUMENTS

| | | | | |
|---|---|---|---|---|
| 5,808,643 A | * | 9/1998 | Tracy et al. | 347/92 |
| 6,270,205 B1 | * | 8/2001 | Takata | 347/85 |

FOREIGN PATENT DOCUMENTS

| | | | |
|---|---|---|---|
| EP | 867 290 | * | 9/1998 |
| JP | 10-264376 | | 10/1998 |
| JP | 10-272769 | | 10/1998 |
| JP | 10-272770 | | 10/1998 |

* cited by examiner

*Primary Examiner*—Michael Nghiem
(74) *Attorney, Agent, or Firm*—Oliff & Berridge, PLC

(57) ABSTRACT

To provide an ink jet head capable of performing proper image forming operations by easily removing air bubbles contained in ink. A manifold 13, 14 is formed with an ink supply channel 41. A plurality of openings 45 are formed at one edge of the ink supply channel 41. The openings 45 are fluidly connected to ink channels 31. The openings 45 have a smaller dimension toward the ink channels 31. During purging or flushing operations, an air bubble EB in the ink supply channel 41 is pulled toward the ink channels 31 while gradually changing it outer shape in the opening 45. In this way, the air bubble is smoothly and easily pulled into the ink channel 31, and ejected through a nozzle 16*a*.

13 Claims, 17 Drawing Sheets

RELATED ART

FIG.17(a')

RELATED ART

FIG.17(b')

RELATED ART

INK JET HEAD CAPABLE OF RELIABLY REMOVING AIR BUBBLES FROM INK

This is a Continuation-In-Part of application Ser. No. 09/049,046 filed Mar. 27, 1998, now U.S. Pat. No. 6,270,205 issued Aug. 7, 2001. The entire disclosure of the prior application is hereby incorporated by reference herein in its entirety.

BACKGROUND OF THE INVENTION

1. Field of the Invention

The present invention relates to an ink jet head, and more particularly to an ink jet head used in an ink jet type printer for ejecting ink to print an image on a recording medium.

2. Description of the Related Art

Non-impact type printers are replacing impact type printers and assuming an increasingly large share of the printer market. Ink jet printers can be raised as the non-impact printer that has the simplest concept and that moreover is easy to apply for multi-tone and color printing.

Japanese Patent-Application Publication (Kokai) No. HEI-10-272770 (corresponding to copending U.S. application Ser. No. 09/049,046) discloses an ink jet head used in an ink jet printer. The head includes an actuator and a manifold connected to the actuator. The actuator is formed with a plurality of ink channels aligned in a row. Each ink channel has an ink inflow port at one end and a nozzle at the other end. The actuator drives the ink channels to eject ink through the nozzles. The manifold is connected to the ink inflow port end of the actuator for supplying ink into the ink channels. The manifold is formed with a supply channel that extends parallel with a direction in which the row of the ink channels extend, and that is in fluid connection with all the ink inflow ports of the ink channels.

Generally, miniscule bubbles are dissolved in the ink supplied to the ink jet head. Dust and other debris are also mixed in the ink. The such air bubbles can grow and clog the ink channels, and the debris can cause defective ink ejection, that can degrade print quality.

In order to overcome these problems, well-known purge operations are performed to recover and maintain the ink ejection function of the ink jet head. Specifically, in a purge operation, a suction cap is brought into contact with the nozzle surface of the ink jet head. A suction pump connected to the suction cap is driven to generate large negative pressure in the suction cap. As a result, a predetermined amount of ink, along with air bubbles and debris, is sucked from the interior of the ink jet head through the suction cap. In this way, the ink in the ink channels and supply channel is replenished and the air bubbles and debris are discharged through the suction cap.

However, it is difficult to remove a relatively large air bubble from the above-described ink jet head because of the following reason.

FIG. 17(*a*) and 17(*a*') show an ink inflow port of an ink channel 131 and an air bubble EB contained in an supply channel 141 of the above-described ink jet head. During the purge operation or flushing operation, ink in the supply channel 141 flows into the ink channel 131. In accordance with this, the air bubble EB, which has a relatively large size, is drawn toward the ink channel 131 and clings to the ink inflow port of the ink channel 131 as shown in FIGS. 17(*b*) and 17(*b*'). At this time, the bubble EB will only seal a portion of the inflow port, and generates an unsealed portion 131*a* at the inflow port. Because the inflow port of the channel 131 is formed in a flat surface, the unsealed portion 131*a* provides a broad space around the air bubble EB. As a result, the ink will freely flow through the unsealed portion 131*a*.

Moreover, when the air bubble EB is slightly sucked into the channel 131 as shown in FIG. 17(*b*), its change in the surface area is rapid, so that a great surface tension is generated on the air bubble BE. The surface tension functions to restore the spherical shape of the air bubble EB.

Because of these reasons, the air bubble EB can not easily be sucked into the in channel 131. Therefore, even if purge and flushing operations are repeatedly performed, the air bubble EB will not be successfully discharged. This will cause insufficient ink supply to the ink channel 131 or improper ejection, thereby degrading quality of printing.

SUMMARY OF THE INVENTION

It is an objective of the present invention to overcome the above-described problems and provide an ink jet head capable of easily discharging air bubbles, preventing defective ink ejection, and printing properly.

In order to achieve the above and other objectives, there is provided an ink jet head including an actuator, a manifold, and a guide. The actuator is formed with an ink channel and a nozzle through which an ink droplet is ejected. The nozzle is fluidly connected to the ink channel. The manifold is attached to the actuator, and to formed with a supply channel. The guide has at least two opposing surfaces that define a guide channel fluidly connecting the supply channel to the ink channel. The guide channel guides an are bubble contained in the supply channel into the ink channel while the opposing surfaces deforming an outer shape of the air bubble.

There is also provided an ink jet head used in an image forming device. The ink jet head includes an actuator, a manifold, and a guide. The actuator is formed with an ink channel and a nozzle through which an ink droplet is ejected. The nozzle is fluidly connected to the ink channel. The manifold is attached to the actuator and formed with a supply channel fluidly connected to the ink channel. The supply channel has a cross-sectional dimension that decreases with proximity toward the ink channel.

Further, there is provided an ink jet printer including an actuator, a manifold, a recovery mechanism, and a guide. The actuator is formed with an ink channel filled with ink and a nozzle through which an ink droplet is ejected. The nozzle is fluidly connected to the ink channel. The manifold is attached to the actuator, and being formed with a supply channel filled with ink. The recovery mechanism performs at least one of a purging operation and a flushing operation for removing an air bubble from the ink in the supply channel. The guide has at least two opposing surfaces that define a guide channel fluidly connecting the supply channel to the ink channel. The guide channel guides the air bubble into the ink channel while the opposing surfaces deforming an outer shape of the air bubble during the at least one of the purging operation and the flushing operation.

BRIEF DESCRIPTION OF THE DRAWINGS

In the drawings:

FIG. 12(*a*') is a plan view of the inlet members, the openings, and the ink channels as viewed from an ink supply channel side of the substrate;

FIG. 12(*b*) is a magnified cross-sectional view of the inlet members, the openings, and the ink channels taken along a line XIIb—XIIb of FIG. 12(*b*');

FIG. 12(*b*') is a plan view of the inlet members, the openings, and the ink channels as viewed from an ink supply channel side of the substrate;

FIG. 12(*c*) is a magnified cross-sectional view of the inlet members, the openings, and the ink channels taken along a line XIIc—XIIc of FIG. 12(*c*');

FIG. 12(*c*') is a plan view of the inlet members, the openings, and the ink channels as viewed from an ink supply channel side of the substrate;

FIG. 14(*b*) is a cross-sectional view of the manifold taken along a line XIV—XIV of FIG. 14(*b*);

FIG. 16(*b*) is a plan view showing the ink channel and the air bubble;

FIG. 17(*a*') is a plan view showing the air bubble and the ink channel of FIG. 17(*a*);

FIG. 17(*b*) is a cross-sectional view showing an air bubble and an ink channel of the conventional ink jet head taken along a line XVIIIa—XVIIIa of FIG. 17(*b*'); and FIG. 17(*b*') is a plan view showing the air bubble and the ink channel of FIG. 17(*b*).

DETAILED DESCRIPTION OF THE PREFERRED EMBODIMENTS

Next, a color ink jet printer including ink jet heads according to preferred embodiments of the present invention will be described while referring to the accompanying drawings.

First, a color ink jet printer 1 including an ink jet head 600 according to a first embodiment of the present invention will be described while referring to FIGS. 1 to 12.

Figure 1:
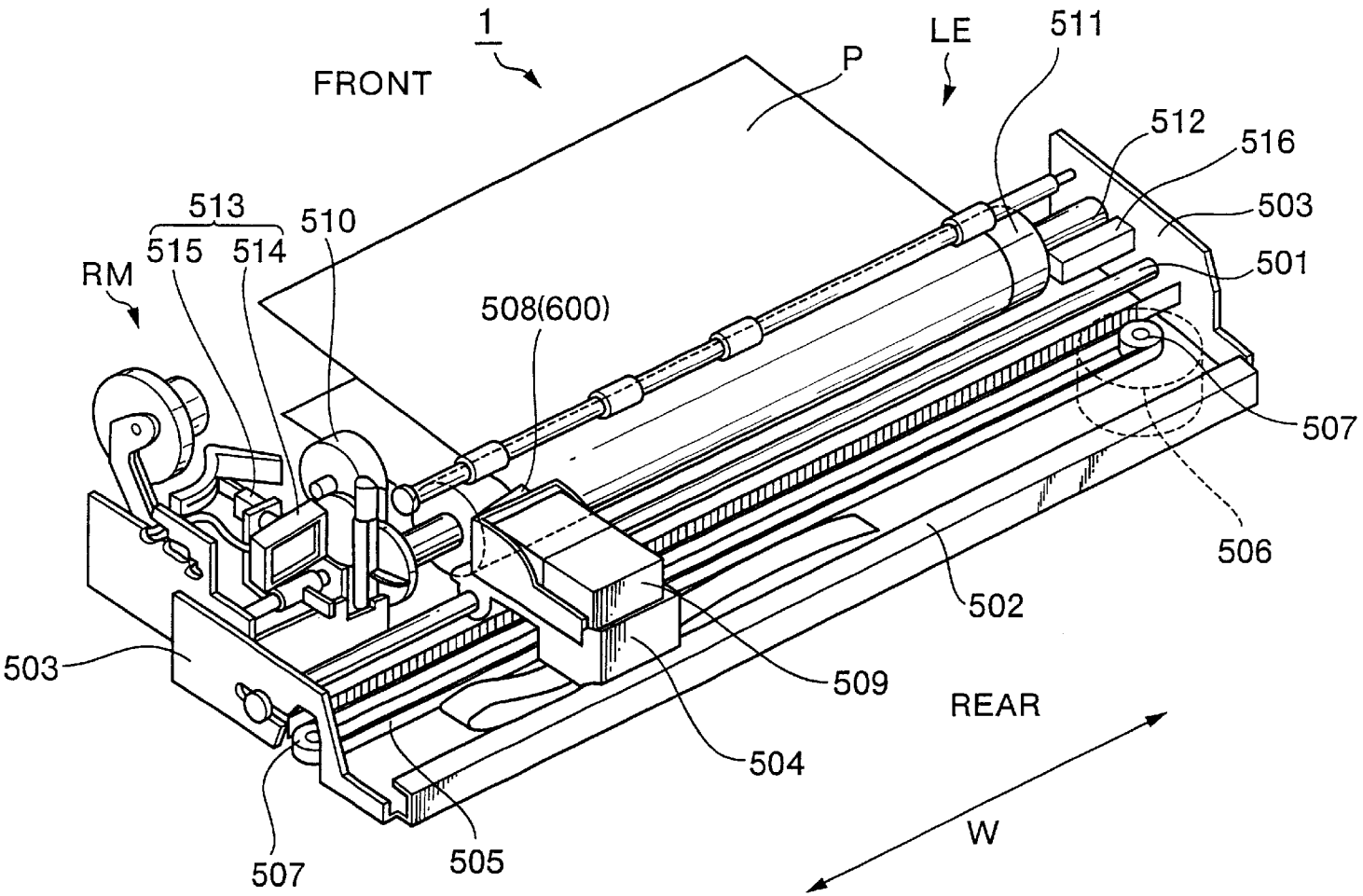
FIG. 1 is a perspective view of a color ink jet printer including an ink jet head according to a first embodiment of the present invention.

As shown in FIG. 1, the color ink jet printer 1 includes a guide rod 501, a guide member 502, a frame 503, a carriage 504, a belt 505, a carriage motor 506, a pair of pulley 507, a head unit 508, a transport mechanism LF, and a recovery mechanism RM.

The guide rod 501 and the guide member 502 extend parallel to each other in a widthwise direction indicated by an arrow W shown in FIG. 1. Both the guide rod 501 and the guide member 502 are fixed to the frame 503 at their ends. The carriage 504 is slidably supported on the guide rod 501 and the guide member 502, and fixed to the belt 505. The pair of pulleys 507 are disposed near the end of the guide rod 501 and the guide member 502. The belt 505 is wound around the pair of pulleys 507. One of the pair of pulleys 507 is fixed to a drive shot of the carriage motor 506. With this configuration, when the carriage motor 506 is driven to rotate, the carriage 504 fixed to the belt 505 is reciprocally moved along the guide rod 501 and the guide member 502.

The head unit 508 is mounted on the carriage 504 and includes a pair of ink jet heads 600 and a cartridge 509. The ink jet heads 600 are disposed next to each other in the direction W and connected to a control circuit 37 shown in FIG. 4. The cartridge 509 is disposed behind the ink jet heads 600. The cartridge 509 stores four different colors of ink, that is, cyan ink, magenta ink, yellow ink, and black ink, and supplies two different colors of ink to each ink jet head 600. Each ink jet head 600 ejects two different colors of ink toward a paper sheet P while reciprocally moving along the guide rod 501, thereby forming four-colored ink images on the paper sheet P.

Figure 6:
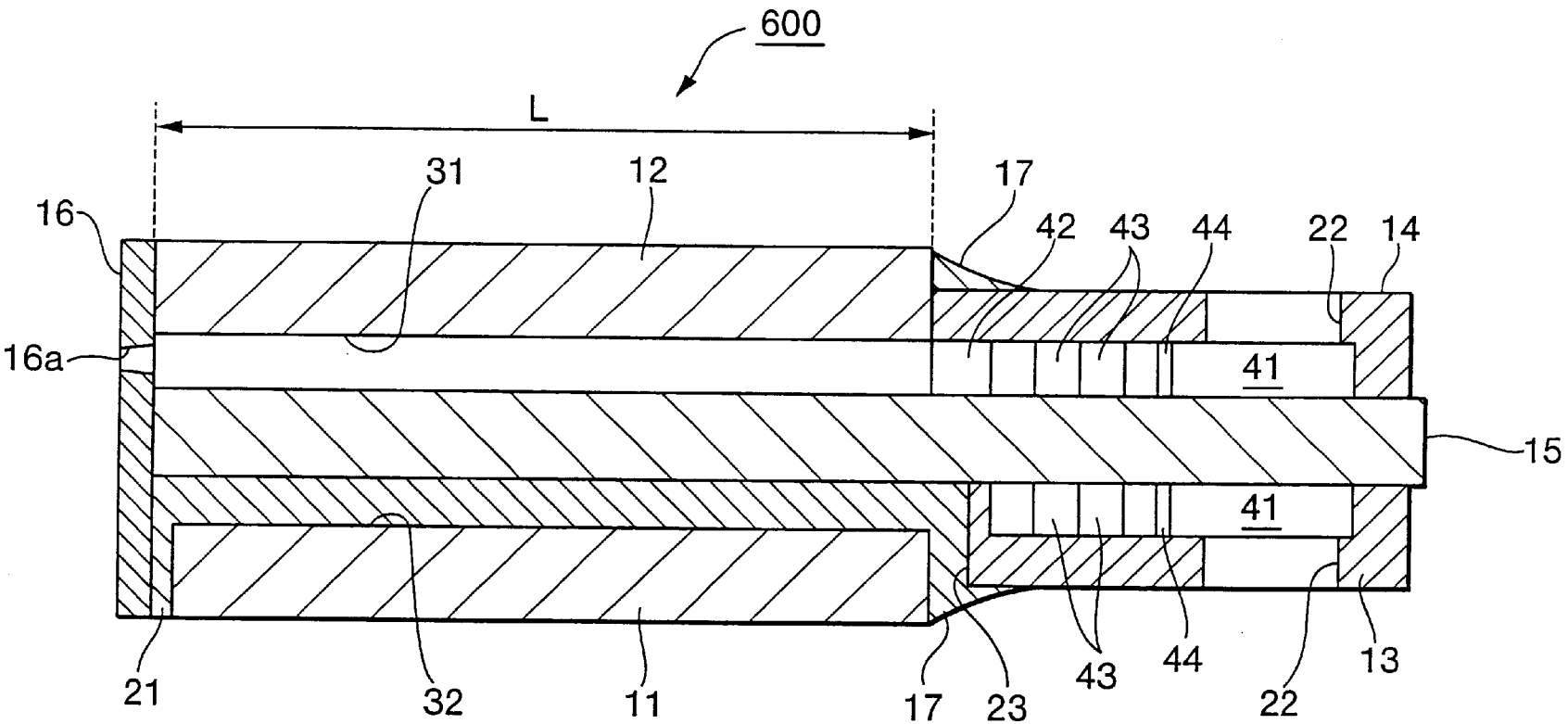
FIG. 6 is a cross-sectional view of the ink jet head taken along a line VI—VI of FIG. 2.

As shown in FIG. 6, the ink jet head 600 includes a nozzle plate 16 formed with a pair of nozzle rows. Each nozzle row includes a plurality of nozzles 16*a* through which an ink droplet is ejected. As will be described later in more detail, each nozzle 16*a* is fluidly connected to an ink channel 31 filled with ink. In this example, the ink jet head 600 is disposed 80 that the nozzle plate 16 faces forward in FIG. 1.

The transport mechanism LF is disposed in confrontation with the ink jet head 600. The transport mechanism LF includes a transport motor 510 and a platen roller 511 having a roller shaft 512. The roller shaft 512 is rotatably supported on the frame 503. When the transport motor 510 is driven to rotate, the platen roller 511 rotates, thereby transporting the paper sheet P in a sheet transport direction at an appropriate timing.

The recovery mechanism RM is for maintaining and recovering the ink jet performance of the ink jet head 600 by removing air bubbles and dust from ink in the ink jet head 600. The recovery mechanism RM includes a purge unit 513 and an ink absorption member 516. The purge unit 513 is disposed near a left end of the platen roller 511 so as to confront the nozzle plate 16 of the ink jet head 600 when the head unit 508 is at a predetermined first reset position. The purge unit 513 performs a purging operation to the ink jet head 600 in the following manner. That is, the purge unit 513 includes an absorption cap 514 and an absorption pump 515 connected to the absorption cap 514. When the purging operation is started, the absorption cap 514 caps over the nozzle plate 16. Then, the absorption pump 515 generates a great negative pressure inside the ink jet head 600, thereby sucking up and collecting a predetermined amount of ink from the inside of the ink jet head 600 through the nozzles 16*a*. At this time, air bubbles and dust contained in the ink will be also collected. If such air bubbles and dust remain and accumulate inside the ink jet head 600, then the ink jet performance of the ink jet head 600 will be degraded. This causes improper printing. However, the above-described purging operation will remove all air bubbles and dust, thereby recovering and maintaining good ink jet performance of the ink jet head 600.

The ink absorption member 516 is disposed near a right end of the platen roller 511 so as to confront the nozzle plate 16 of the ink jet heads 600 when the head unit 508 is positioned at a second predetermined reset position. The ink absorption member 516 to a plate-shaped porous member having excellent ink absorbing capability. Before the ink jet heads 600 perform the image forming operation, the ink jet heads 600 perform a flushing operation at the second reset position. That is, each ink jet head 600 ejects a predetermined amount of ink toward the ink absorption member 516. At this time, air bubbles and dust are also ejected along with the ink. The ejected ink as well as the air bubbles and dust is absorbed into the ink absorption member 516. In this way, malfunction of the ink jet head 600 caused by air bubbles and dust inside the ink jet head 600 will be prevented, and the ink jet heads 600 can reliably perform the proper image forming operation.

Figure 2:
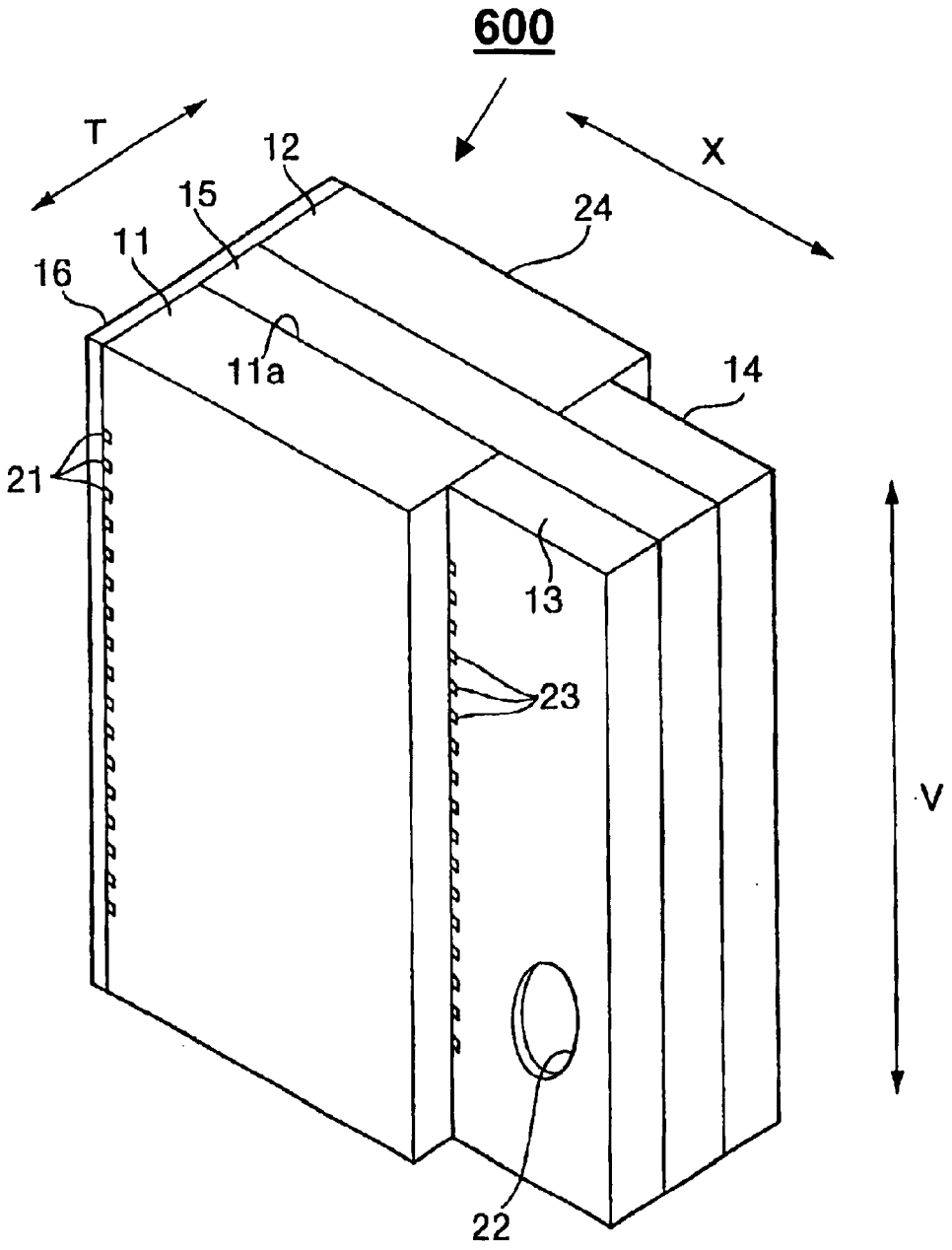
FIG. 2 is a perspective view showing the ink jet head of FIG. 1.

Next, detailed explanation of the ink jet head 600 of FIG. 1 will be provided. As shown in FIG. 2, the ink jet head 600 includes a pair of substrates 11, 12, a pair of manifolds 13, 14, a plate member 15, and the nozzle plate 16. The substrates 11, 12, the plate member 15, and the nozzle plate 16 together configure an actuator 24.

The substrates 11, 12 and the plate member 15 are all formed in a plate like shape. The substrates 11, 12 are fixed to side surfaces of the plate member 15 so as to sandwich the plate member 15 therebetween. The plate member 15 protrudes rearward from the substrates 11, 12 in the direction X. The manifold 13 is fixed to a corner portion defined by the rear portion of the substrate 11 and the side surface of the plate member 15. In the same manner, the manifold 14 is fixed to a corner portion defined by the rear portion of the substrate 12 and the side surface of the plate member 15. The nozzle plate 16 is fixed to the front end of the substrates 11, 12 and the plate member 15.

Bach substrate 11, 12 is formed at its front end portion with a plurality of outlet grooves 21 aligned in a vertical direction indicated by an arrow V. Each manifold 11, 12 is formed with a circular-shaped ink supply hole 22 at its bottom portion. Each manifold 11, 12 is also formed with a plurality of inlet grooves 23 at its front end portion aligned in the direction V. Details will be described later.

Figure 3:
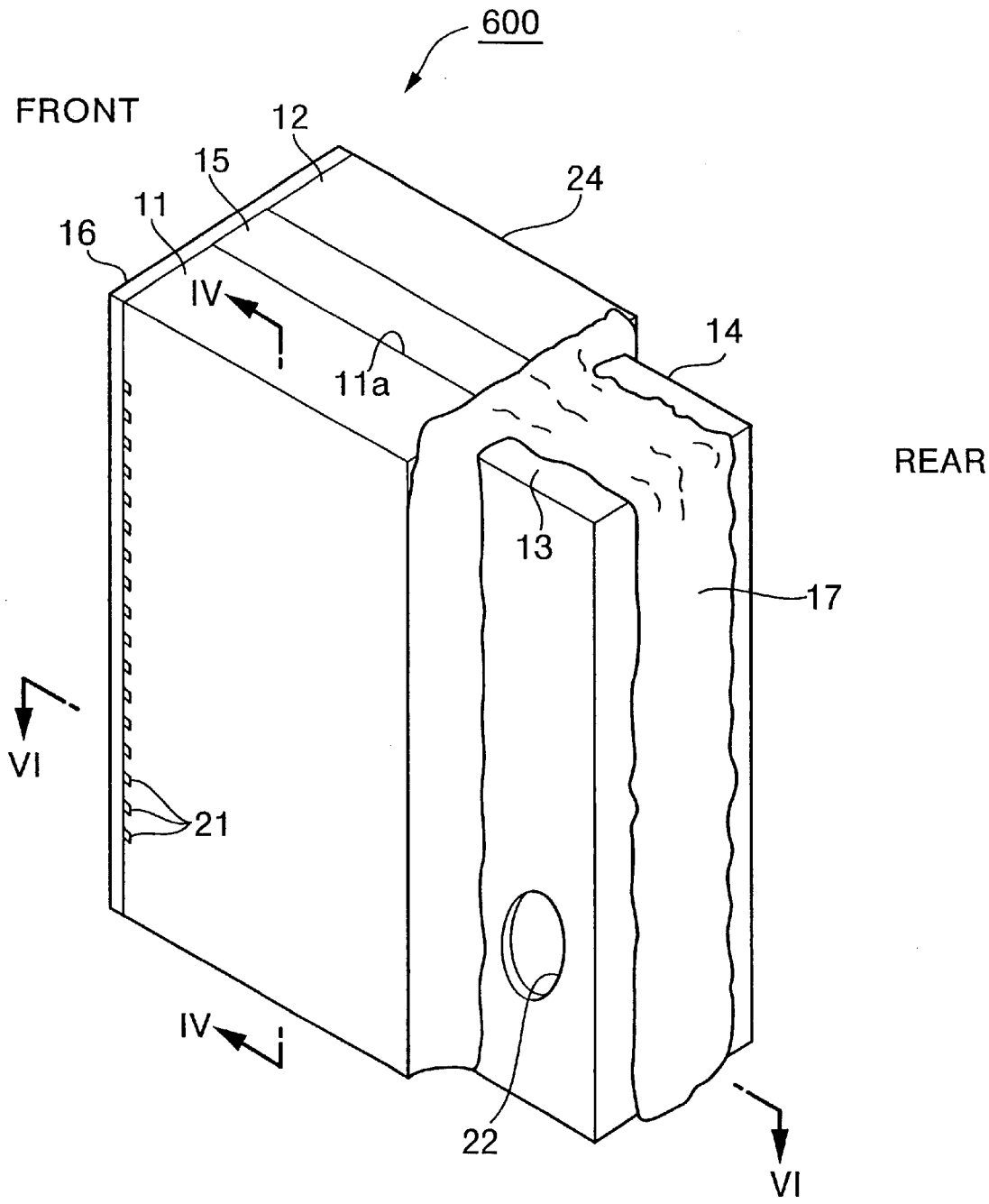
FIG. 3 is a perspective view showing the ink jet head with a sealing agent applied thereto.

As shown in FIG. 3, a sealing agent 17 is applied around the contact portions between the manifold 13, 14 and the plate member 15 and between the manifold 13, 14 and the substrate 11, 12, that is, the rear portion of the substrate 11, 12, the rear portion of the plate member 15, and the periphery of the manifold 13, 14. In this way, the sealing agent 17 fixes the manifold 13, 14 to the plate member 15, and prevents ink from leaking out of the manifold 13, 14. The sealing agent 17 also seals off the inlet grooves 23. The sealing agent 17 is formed from a deformable material, such as silicon rubber.

Figure 8:
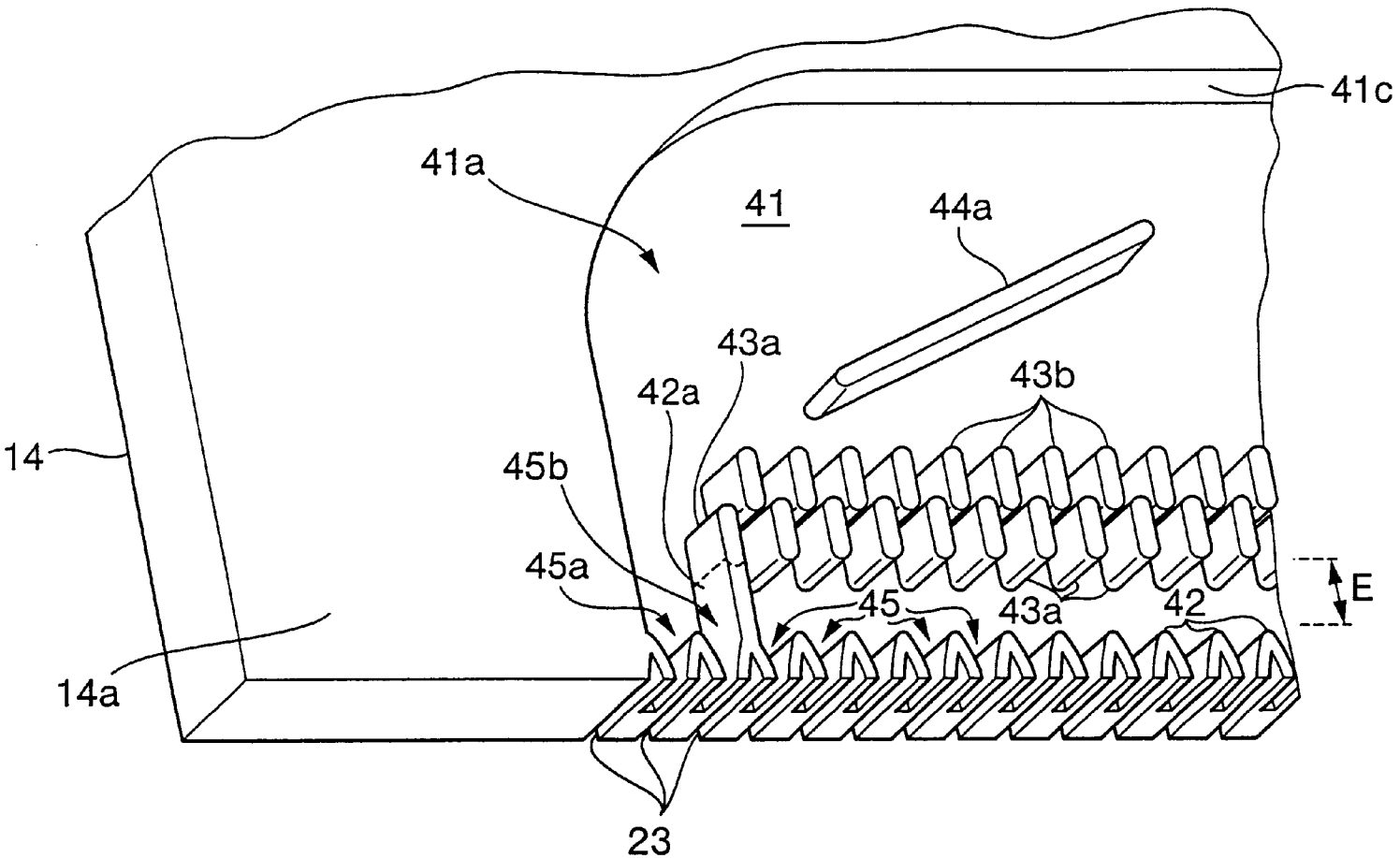
FIG. 8 is a partial perspective view of a manifold of the ink jet head.
Figure 9:
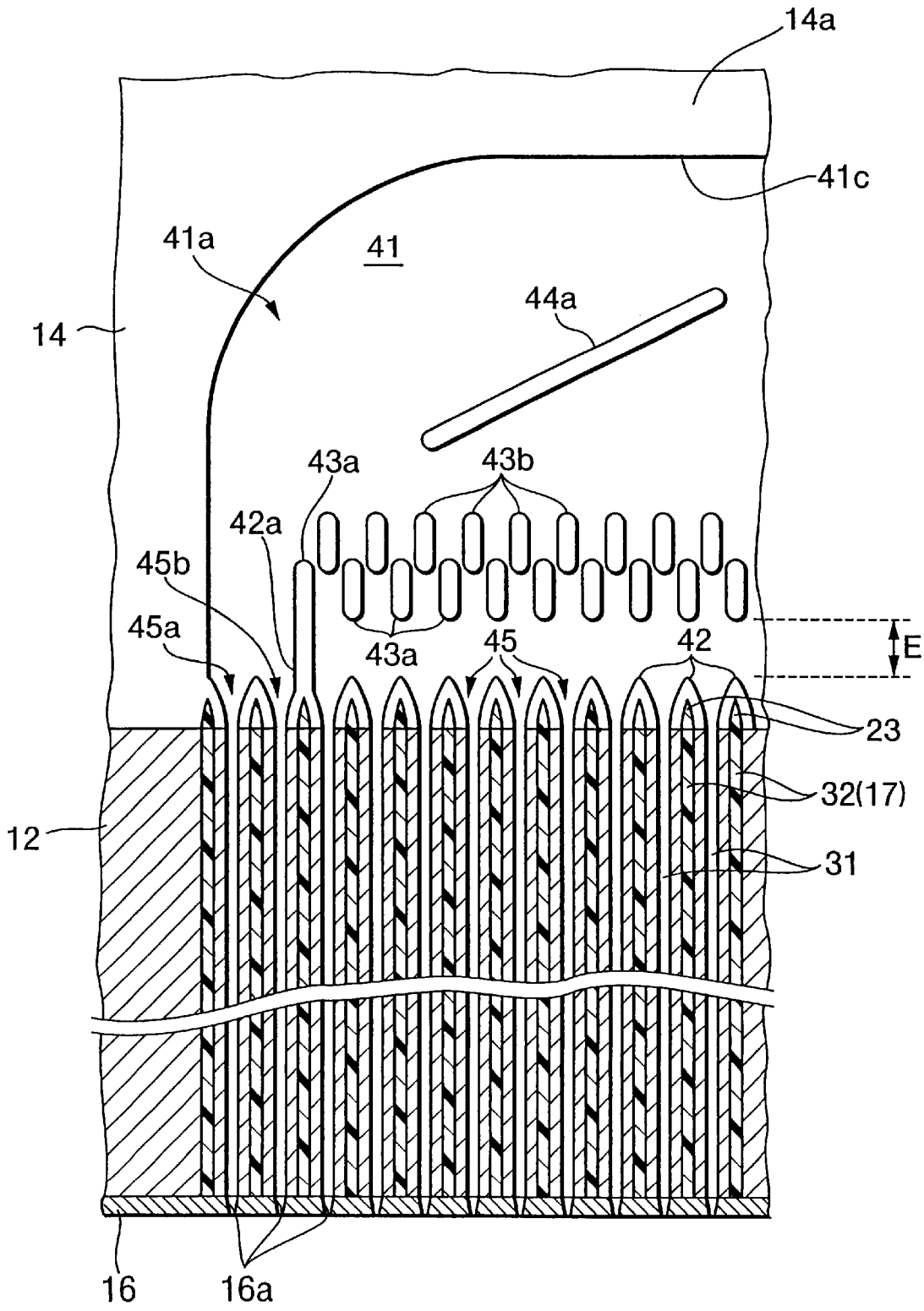
FIG. 9 is a plan view of an inner surface of the manifold and the substrate attached to the manifold.
Figure 10:
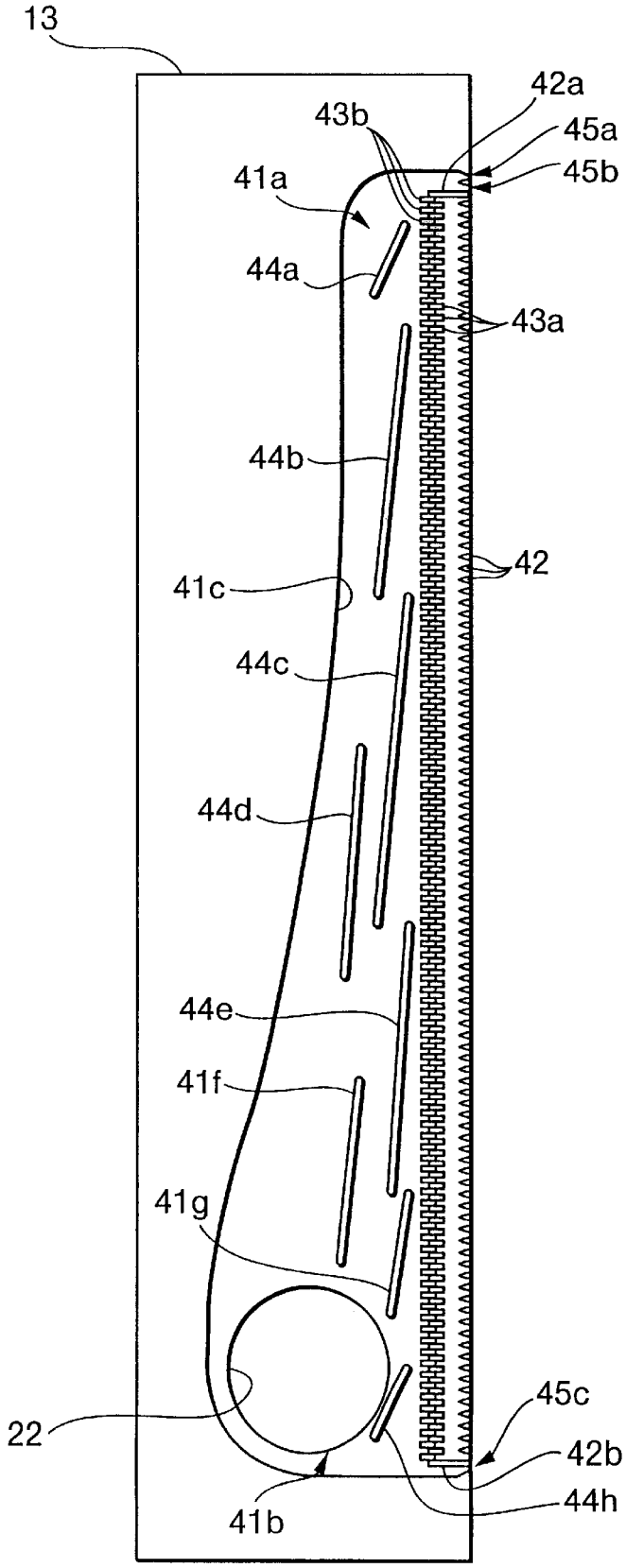
FIG. 10 is a plan view showing one inner surface of the manifold.
Figure 11:
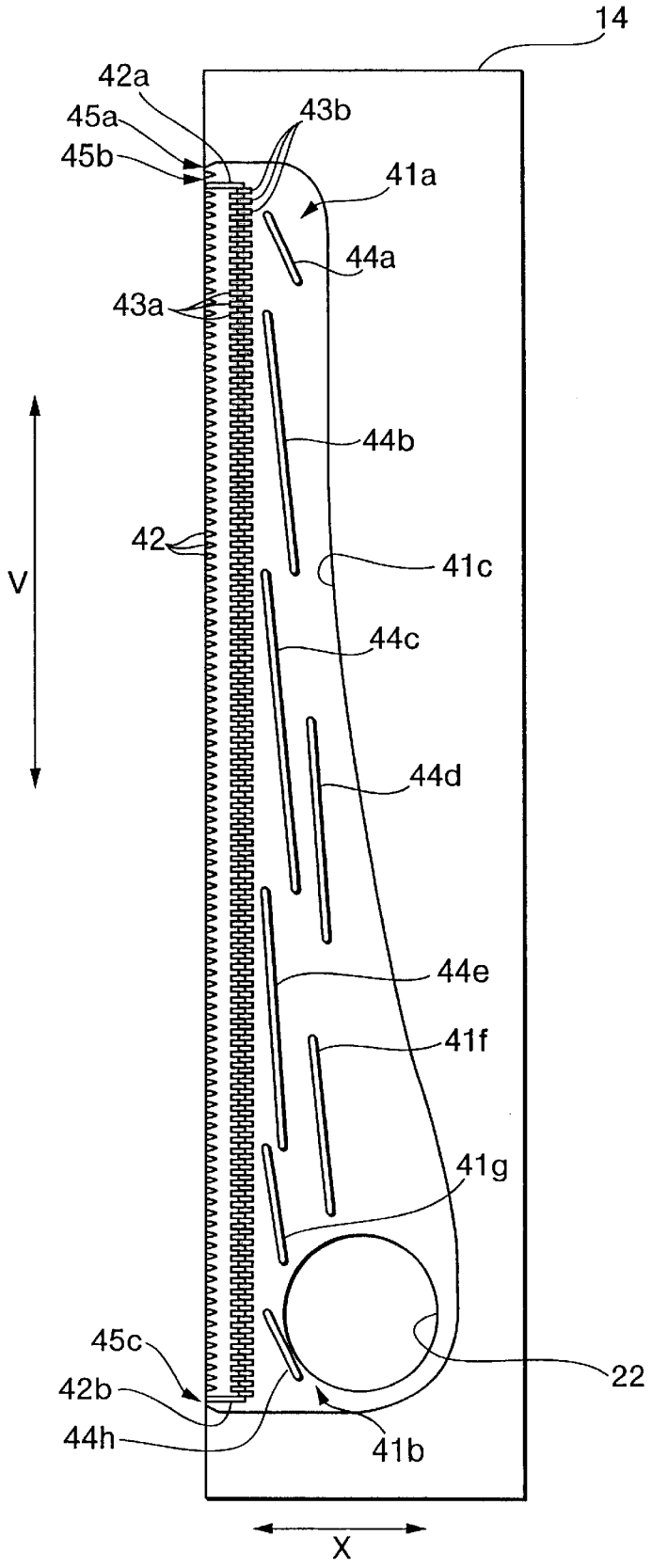
FIG. 11 is a plan view showing one inner surface of another manifold.
Figure 12A:
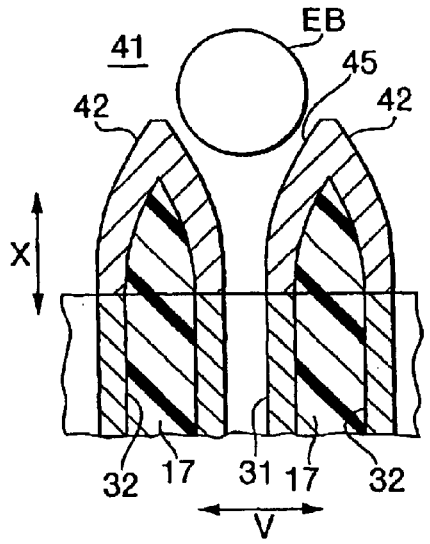
FIG. 12(*a*) is a magnified cross-sectional view of inlet members, openings, and ink channels of the ink jet head taken along a line XIIa—XIIa of FIG. 12(*a*')
Figure 12A:
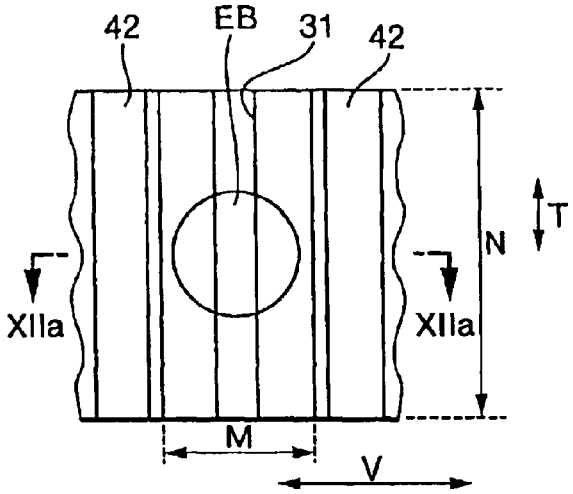
Figure 12B:
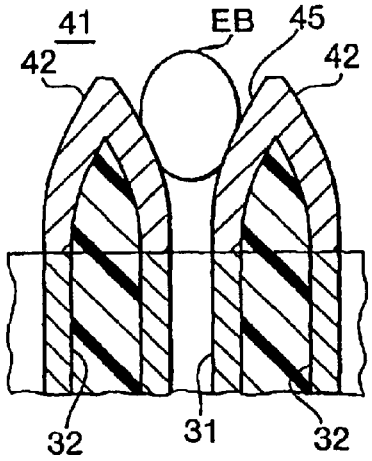
Figure 12B:
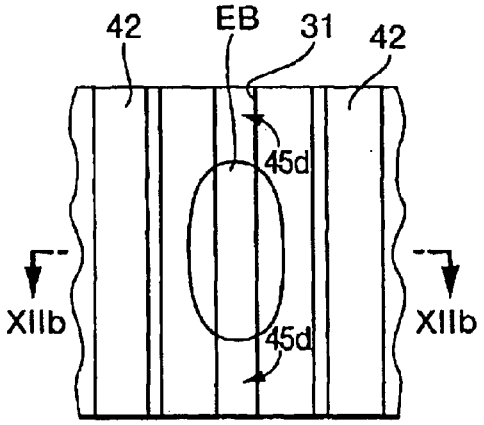
Figure 12C:
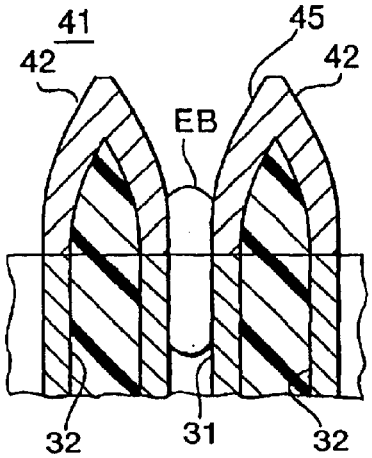
Figure 12C:
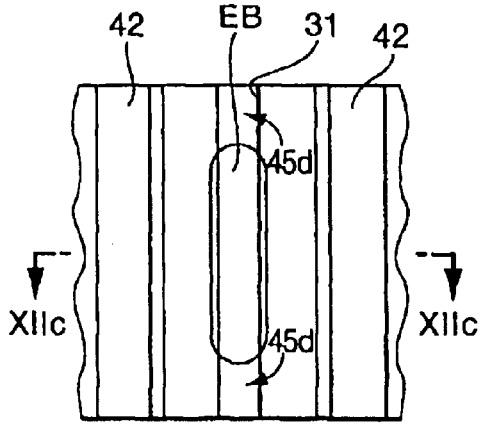

Here, it should be noted that FIGS. 4 to 9 are explanatory view of configuration of the ink jet head 600, and that some components of the ink jet head 600 are shown in an exaggerated manner in order to facilitate explanation, so the dimensional ratio of these components shown in FIGS. 4 to 9 is different from the actual dimensional ratio. Further, the dimensional ratio of the manifold 13, 14 shown in FIGS. 4 to 9 is inconsistent with those shown in FIGS. 10 and 11. FIGS. 10, 11 shows the manifold 13, 14 in the actual dimensional ratio, It should be also noted that the substrates 11 and 12 are symmetric with respect to the plate member 15. Therefore, only the substrate 11 will be described below, and explanation for the substrate 12 will be omitted.

Figure 4:
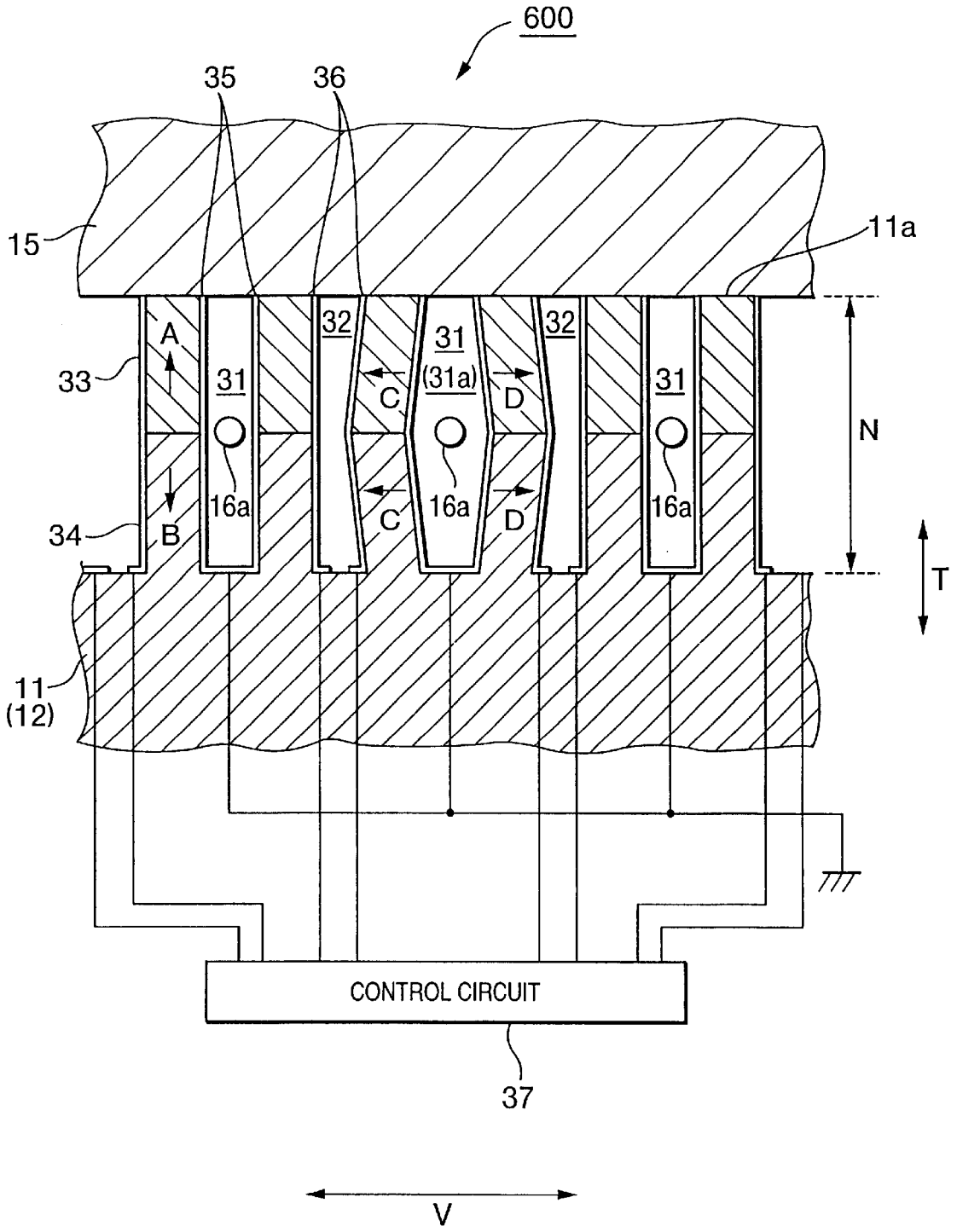
FIG. 4 in a cross-sectional view of the ink jet head taken along a line IV—IV of FIG. 2.
Figure 5:
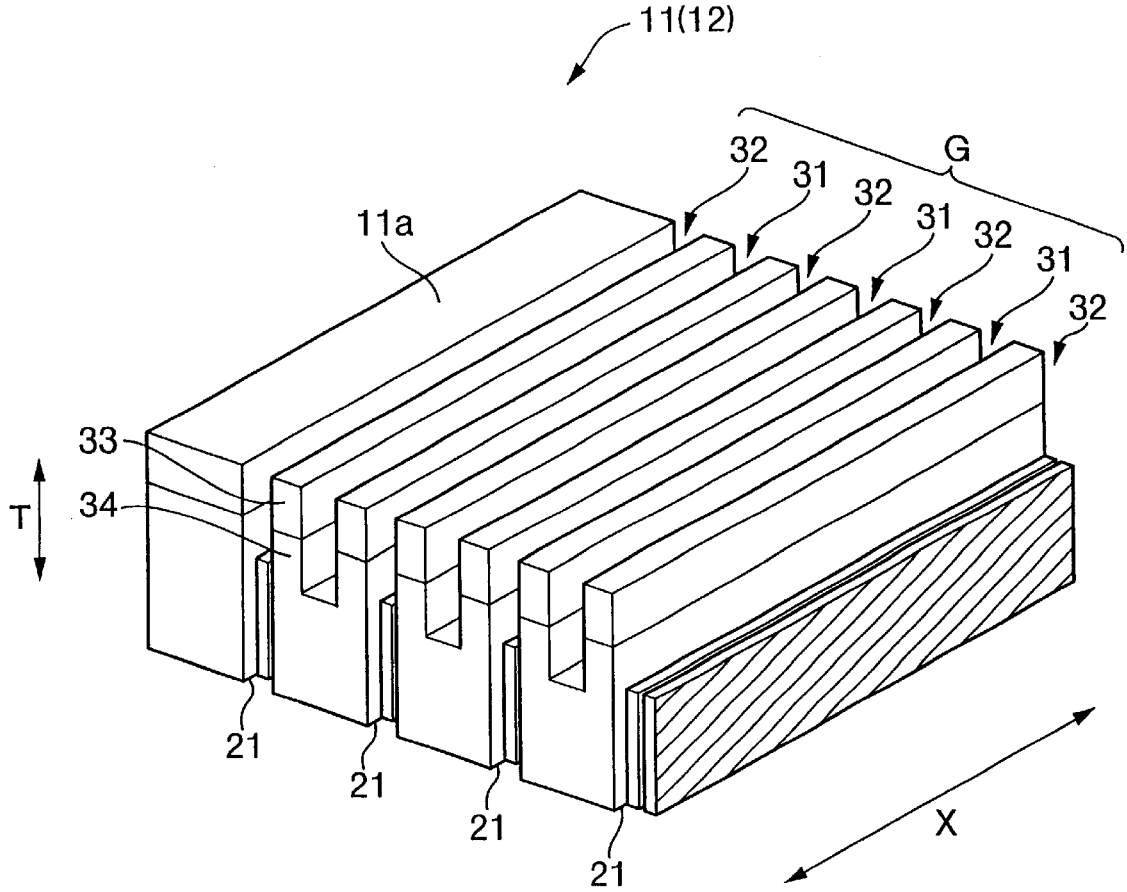
FIG. 5 is a perspective view of a substrate included in the ink jet head.

As shown in FIGS. 4 and 5, the substrate 11 has an inner surface 11*a* at which the substrate 11 is fixed to the plate member 15. The inner surface 11*a* is formed with a plurality of grooves G, each extends in the direction X. Each groove G has a rectangular cross-sectional shape, and is opened at both ends in the direction X. The grooves G with the plate member 15 fixed to the inner surface 11*a* define a plurality of ink channels 31 and a plurality of dummy channels 32, arranged in an alternate manner. That is, each ink channel 31 is sandwiched between adjacent two dummy channels 32. As shown in FIGS. 4 and 6, the ink channel 31 has a length N in the direction T a length L in the direction X. Further, the substrate 11 is formed with the plurality of outlet grooves 21 extending in the direction T at its front end portion. Each outlet groove 21 is connected to a front end of the dummy channel 32.

As shown in FIG. 4, each channel 31, 32 is defined by upper walls 33 and lower walls 34 of the substrate 11. The upper walls 33 and the lower walls 34 are shear-mode actuator walls made of piezoelectric materials, such as piezoelectric ceramics. The upper walls 33 are fixed to the plate member 15, and have a polarity in a direction indicated by an arrow A. The lower walls 34 are connected to a bottom surface of the channel 31, 32, and have a polarity in a direction indicated by an arrow B which is opposite to the direction A.

An electrode 35 is provided to the inner side surface and the button surface of each ink channel 31 and is electrically grounded. An electrode 36 is provided to each inner side surface, but not to the bottom surface, of the dummy channel 32. The electrode 36 is electrically connected to the control circuit 37. The control circuit 37 generates and selectively outputs driving signals to the electrodes 36.

The nozzle plate 16 is formed with a pair or nozzle rows extending in the direction V. Each nozzle row includes a plurality of nozzles 16*a* shown in FIGS. 4 and 6 at positions corresponding to the ink channels 31 of the substrate 11, 12 so that the nozzles 16*a* and the ink channels 31 are fluidly connected to each other.

As shown in FIG. 6, each dummy channel 32 is fluidly connected to the inlet groove 23 of the manifold 13 as shown in FIG. 6. The sealing agent 17 is applied to the inlet groove 23 so as to block up the inlet groove 23. In this way, ink supplied from an ink supply channel 41 (to be described later) into the ink channels 31 is prevented from entering the dummy channels 32. In FIG. 6, all the inlet grooves 23, the dummy channels 32, and the outlet grooves 21 are filled up with the sealing agent 17. This is because when the sealing agent 17 is applied around the inlet grooves 23, a negative pressure in generated in the dummy channels 32 from the outlet groove 21 side, and the sealing agent 17 is introduced from the inlet grooves 23 into the dummy channels 32 and the outlet grooves 21. However, it is unnecessary to fill the ink channels 31 and outlet grooves 21 with the sealing agent 17 as long as the inlet grooves 23 are blocked up.

Next, the manifolds 13 and 14 will be described. However, because the manifolds 13 and 14 are symmetric with respect to the plate member 15, only the manifold 14 will be described below, and explanation for the manifold 13 will be omitted.

Figure 7:
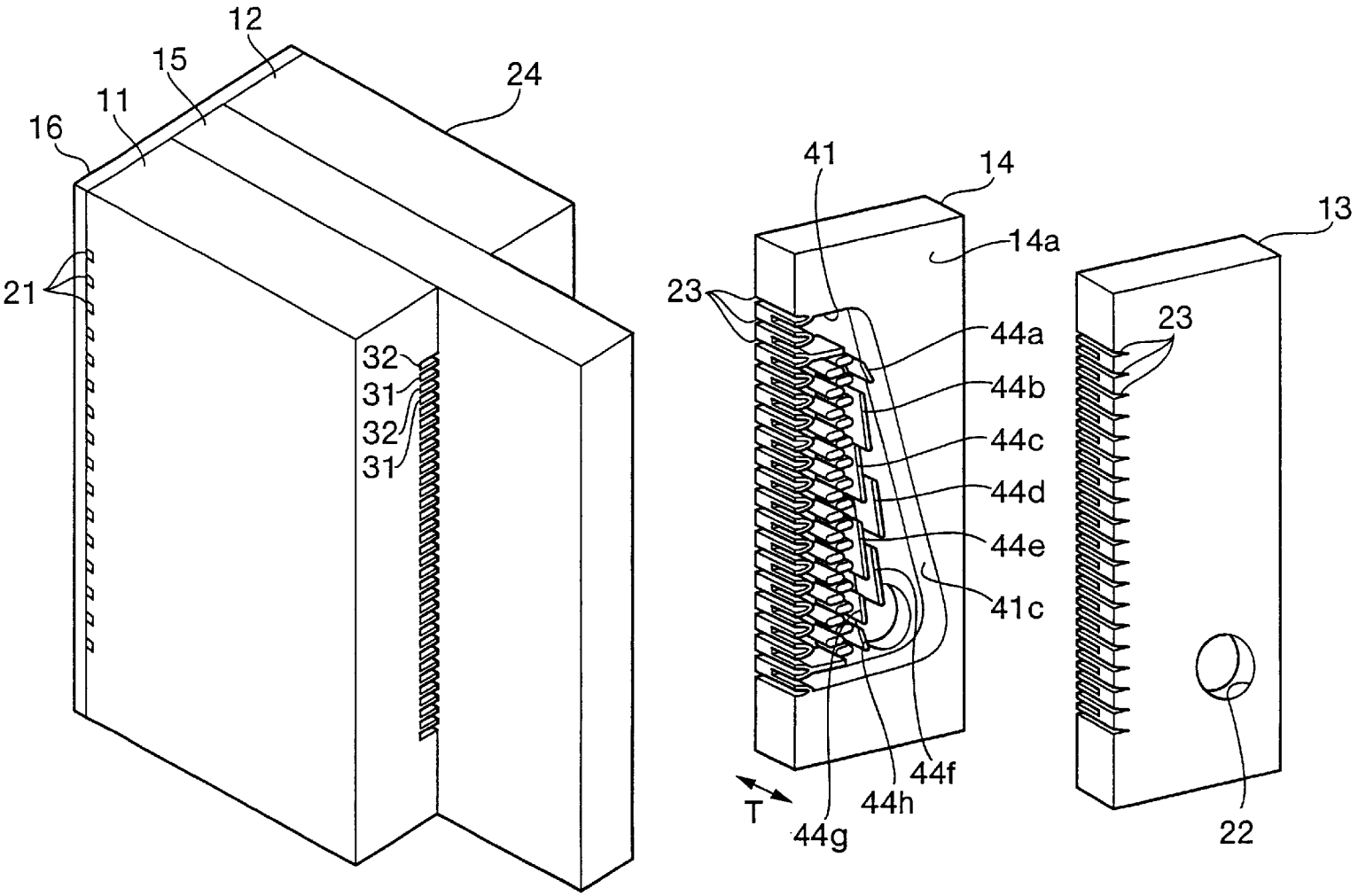
FIG. 7 is an exploded perspective view of the ink jet head.

As shown in FIGS. 6 to 11, the manifold 14 has an inner surface 14*a* at which the manifold 14 is attached to the plate member 15. The inner surface 14*a* is formed with a groove defining the ink supply channel 41. A front side of the ink supply channel 41 is opened and an opposite rear aide is defined by a side wall 41*c*. The ink supply channel 41 is formed to a uniform length N in the thickness direction T, which is equal to the length N of the ink channel 31. The ink supply channel 41 extends in the direction V in which each nozzle row extends as described above. As shown in FIGS. 7 and 11, the ink supply channel 41 has an upper side 41*a* and a lower side 41*b*. The ink supply channel 41 has a greater width in the direction X toward the lower side 41*b*. The ink supply channel 41 is formed with the ink supply hole 22 at the lower aide 41*b*. The ink supply hole 22 is fluidly connected to the cartridge 509.

A plurality of inlet members 42, a filter 43, and ribs 44*a* to 44*h* are formed inside the ink supply channel 41 so as to protrude in the direction T perpendicular to the inner surface 14*a* of the manifold 14. When the manifold 14 is fixed to the plate member 15, the protruding end portions of the inlet members 42, the filter 43, and the ribs 44*a* to 44*h* are also fixed to the plate member 15 in an ink seal-up manner.

The substrates 13, 14 are formed from compound resin by ejection molding method together with the ink supply channel 41, the inlet members 42, the filter 43, and the ribs 44*a* to 44*h*.

The inlet members 42 are aligned in the direction V at the opened front edge of the ink supply channel 41 while defining an opening 45 between each adjacent two inlet members 42. As shown in FIGS. 12(*a*) and 12(*a*'), each inlet member 42 has a spindle shape with a tapered outer surface. Accordingly, the opening 45 is widest near the tip of the inlet members 42, and tapers to a width M in the direction V nearer the ink channel 31. The inlet grooves 23 described above are formed at the front end of the manifold 14 at positions corresponding to the inlet members 42. Both ends of the inlet grooves 42 owe opened. As shown in FIG. 9, when the front edge portion of the manifold 14 is attached to the substrate 12, then the openings 45 are fluidly connected to the ink channels 31, and the inlet grooves 23 are connected to the dummy channels 32.

The filter 43 extends in the direction V and includes a plurality of filter members 43*a* and 43*b* arranged in a staggered manner. Each filter member 43*a*, 43*b* has a column shape with an oval cross-section. As shown in FIG. 8, the filter members 43*a* are disposed separate from the tip of the inlet members 42 by a predetermined distance E at positions corresponding to the inlet members 42. The filter members 43*b* are disposed at positions corresponding to the openings 45 at a side of the filter is members 43*a* opposite from the inlet members 42. Round end portions of the adjacent filter members 43*a* and 43*b* are located close to each other without contacting each other so as to define a space therebetween. The space is small enough to prevent small air bubbles and dust contained in ink from passing through the space.

It should be noted that as shown in FIGS. 9 and 11, the openings 45 include openings 45*a* and 45*b* at the most upper side 41*a* and an opening 45*c* at the most lower side 41*b*, and that no filter member is formed at positions corresponding to the openings 45*a*, 45*b*, 45*a*. Also, the inlet members 42 include inlet members 42*a*, 42*b* located next to the openings 45*b*, 45*c*, respectively. The inlet members 42*a*, 42*b* are elongated and connected to the corresponding filter members 43*a*.

As shown in FIG. 11, the ribs 44*a* to 44*h* are disposed between the side wall 41*c* and the filter 43 for leading ink introduced from the ink supply hole 22 toward the upper side 41*a*. Each rib 44*a* to 44*h* has a thin plate shape and is disposed diagonal with respect to the direction V. The filters 44*a*, 44*b*, 44*c*, 44*e*, 44*g*, 44*h* are arranged to align in the direction V. The filter 44*h* is disposed between the ink supply hole 22 and the filter 43. The filters 44*d* and 44*f* are disposed at positions corresponding to gaps between the filters, 44*b*, 44*c*, 44*e*, 44*g*.

With the above-described configuration, each different color of ink stored in the cartridge 509 is supplied into the ink channels 31 of the substrate 11, 12 through the ink supply hole 22, the ink supply channel 41, and the openings 45 of the manifold 13, 14. The substrate 11 and the substrate 12 for different colors of ink are completely separated by the plate member 15. Therefore, even if the manifolds 13, 14 are attached to the rear portion of the substrates 11, 12 somewhat imprecisely during manufacture, the ink channels 31 of the substrate 11 and the ink channels 31 of the substrate 12 will not be connected to each other. Therefore, undesirable mixture of different colors of ink will not occur, and reliable separation of ink color can be realized. Accordingly, proper image forming operations can be performed.

Next, an ink ejection operation of the present embodiment will be described. In this example, an ink droplet is ejected from a target ink channel 31*a* shown in FIG. 4. All ink channels 31 including the target ink channel 31*a* are already filled with ink. In this condition, the control circuit 37 outputs a driving signal having a predetermined voltage EV to the electrodes 36 provided to one side surface, which is closer to the target ink channel 31*a*, of the dummy channels 32 that sandwich the target ink channel 31*a* therebetween. Then, electric fields having directions C and D are generated in the upper walls 33 and the lower walls 34 that define the target ink channel 31*a*. The electric fields make the upper walls 33 and lover walls 34 deform in the directions C and D, thereby increasing volume of the target ink channel 31*a*. Accordingly, internal pressure of the target ink channel 31*a* decreases. Then, more ink in supplied into the target ink channel 31*a* from the cartridge 509. It should be noted that because the sealing agent 17 filling in the dummy channels 32 is formed from the deformable material as described above, the sealing agent 17 will not interfere with deformation of the upper walls 33 and the lower walls 34.

The driving signal from the control circuit 37 has a duration T which is equal to a time duration required by a pressure wave to propagate through the in ink inside the ink channel 31 in the longitudinal direction X one time. The duration T can be obtained by the following equation;

$$T=L/S;$$

wherein L is the length of the ink channel 31 in the direction X; and

S is the speed of the sound.

According to the transmission theory of pressure wave, when the time duration T has elapsed from when the driving signal is first outputted, the negative pressure inside the ink channel 31 is inverted into a positive pressure. At the exact timing when the negative pressure inverts into the positive pressure, the control circuit 37 stops outputting the driving signal. Then, a voltage applied on the electrodes 36 will be 0V. As a result, the upper walls 33 and the lower walls 34 return into the initial condition, thereby decreasing the volume and increasing the internal pressure of the ink channel 31*a*. The above-described positive pressure and the increased internal pressure together provide a relatively great pressure on ink in the ink channel 31*a* near the nozzle 16*a*. As a result, an ink droplet is ejected from the ink channel 31*a* through the nozzle 16*a*.

Next, functions and effects of the present embodiment during the purging and flushing operations will be described while referring to FIGS. 12(*a*) and 12(*c*'). The openings 45 are fluidly connected to the ink channels 31. Also, the openings 45 have the width M, and also have the length N which is equal to the length N of the ink channel 31 (FIG. 4). The width M decreases with proximity to the ink channel 31, but is uniform across the entire length N. The length N is formed greater than the width M. In other words, the opening 45 has a rectangular cross-sectional area having a high aspect ratio, that is, a ratio of the length N to the width M. The wide-width portion of the opening 45 near the tip of the inlet members 42 has a cross-section close to a square shape.

The ink channel 31 also has a rectangular cross-section with a large aspect ratio. The cross-sectional of the ink channel 31 is uniform across the entire length L. That is, the cross-section of the opening 45 near the ink channel 31 is the same as the cross-section of the ink channel 31.

It is supposed that ink inside the ink supply channel 41 contains a relatively large air bubble EB shown in FIGS. 12(*a*), 12(*a*'). The air bubble EB originally has a spherical shape. Such an spherical air bubble EB will position at and block the wide-width portion of the opening 45. As the ink flows from the ink supply channel 41 to the ink channel 31 during the purging operation or the flushing operation, the air bubble EB is pulled toward the ink channel 31. Then, as shown in FIGS. 12(*b*) and 12(*b*'), the air bubble EB partially enters the opening 45 while changing its outer shape. The amount of outer surface area of the air bubble EB which is changed at this time is smaller compared with the conventional case shown in FIG. 17. Accordingly, distortion force of the air bubble EB trying to retune to its original spherical shape is also smaller. The distortion force is caused by the surface tension of the air bubble EB. Therefore, because of the relatively small distortion force of the air bubble EB and because of the wide-width portion of the opening 45, the air bubble EB can be easily pulled further toward the ink channel 31.

As the air bubble EB is further pulled toward the ink channel 31, the shape of the air bubble EB eventually becomes close to the rectangular cross-section of the ink channel 31 as shown in FIGS. 12(*c*) and 12(*a*'). Therefore, the air bubble EB can be smoothly introduced into the ink channel 31, and then ejected out of the ink channel 31.

It should be noted that as shown in FIG. 12(*b*') and 12(*c*'), gaps 45*d* may be formed between the air bubble EB and the inlet members 42 without the air bubble EB completely blocking up the opening 45. However, in this case also, the air bubble EB can be smoothly pulled into the ink channel 31 in the following manner. That is, the ink will flow through the gaps 45*d* along the tapered side surface of the inlet members 42 and the peripheral surface of the air bubble EB only in a direction toward the ink channel 31. Also, the flowing speed of the ink increases toward the ink channel 31 because the width M of the opening 45 decreases. Such an ink flow generates a force that pulls the air bubble EB toward the ink channel 31. As a result, the air bubble EB can be smoothly introduced into the ink channel 31.

As described above, according to the configuration of the present embodiment, the purging or flushing operation can reliably remove an air bubble from ink in the ink jet head 600 even if the air bubble has a relatively large size. This prevents failure in the ink jet operation, thereby enabling a proper image forming operation.

Also, because the manifold 13, 14 is formed integrally with the inlet members 42 from a compound resin by an ejection molding method, the minute and precise inlet members 42 can be easily formed.

It should be noted that the wide-width portion of the opening 45 desirably has a cross-sectional shape close to a square or circle.

Next, an ink jet head 700 according to a second embodiment of the present invention will be described while referring to FIGS. 13 to 16. Components common to both the first and second embodiments will be assigned with the some numbering and their explanation will be omitted.

Figure 13:
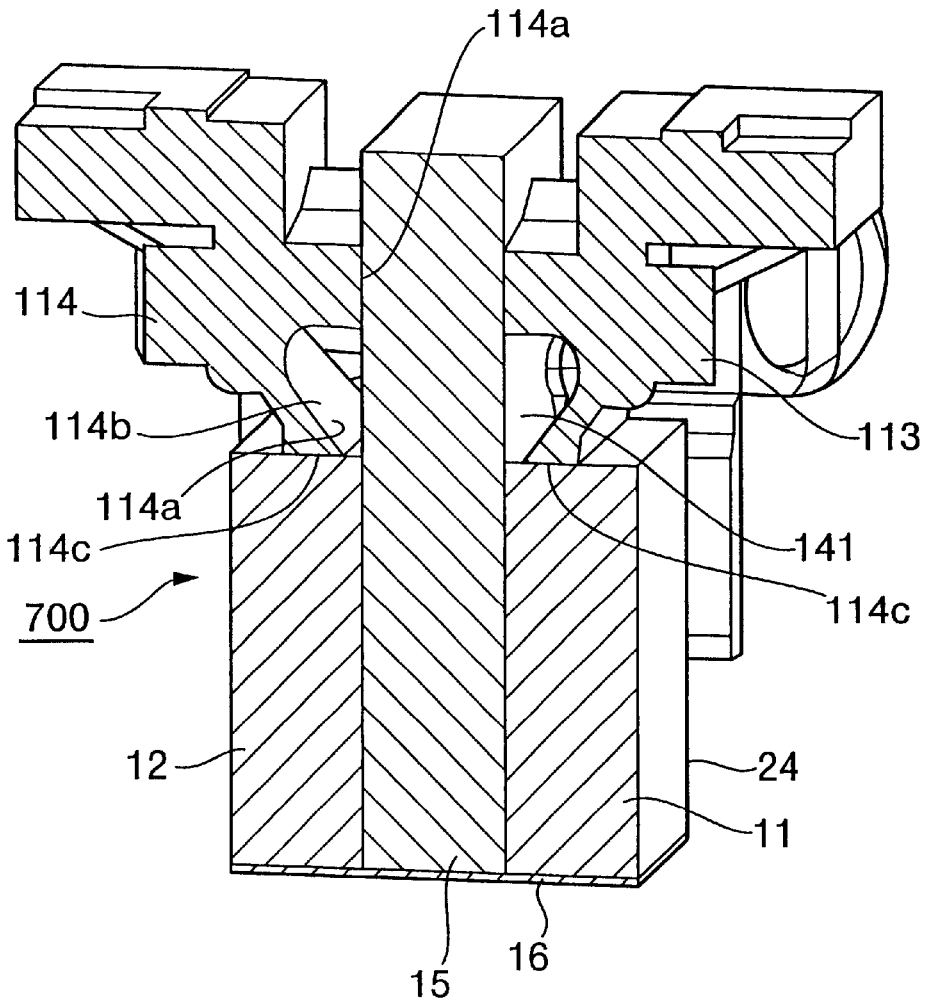
FIG. 13 is a cross-sectional view of an ink jet head according to a second embodiment of the present invention.

As shown in FIG. 13, the ink jet head 700 includes the substrates 11, 12, the plate member 15, and the nozzle plate 16 together configuring the actuator 24. The ink jet head 700 also includes a pair of manifolds 113, 114. The manifold 113 is attached to the corner portion defined by the rear portion of the substrate 11 and the side surface of the plate member 15. Similarly, the manifold 114 is attached to the corner portion defined by the rear portion of the substrate 12 and the side surface of the plate member 15. Because the manifolds 113 and 114 are symmetrical with respect to the plate member 15, only the manifold 114 will be described below.

Figure 14A:
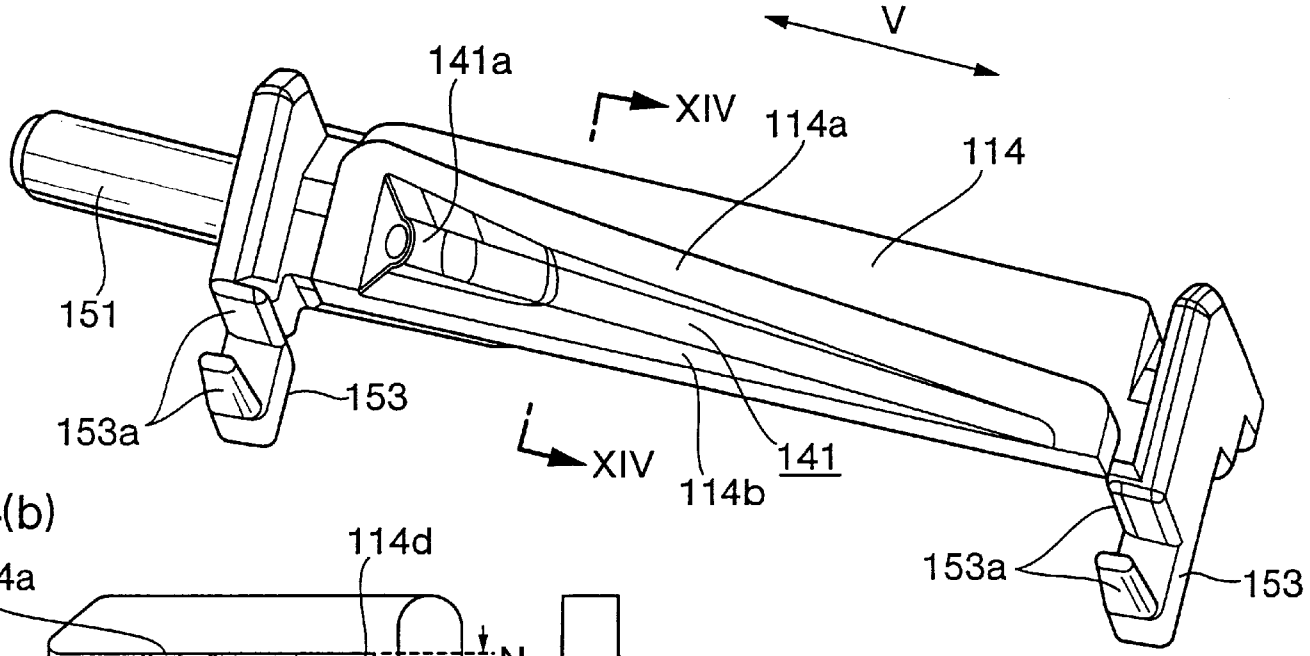
FIG. 14(*a*) is a perspective view of a manifold of the ink jet head of FIG. 13.
Figure 14B:
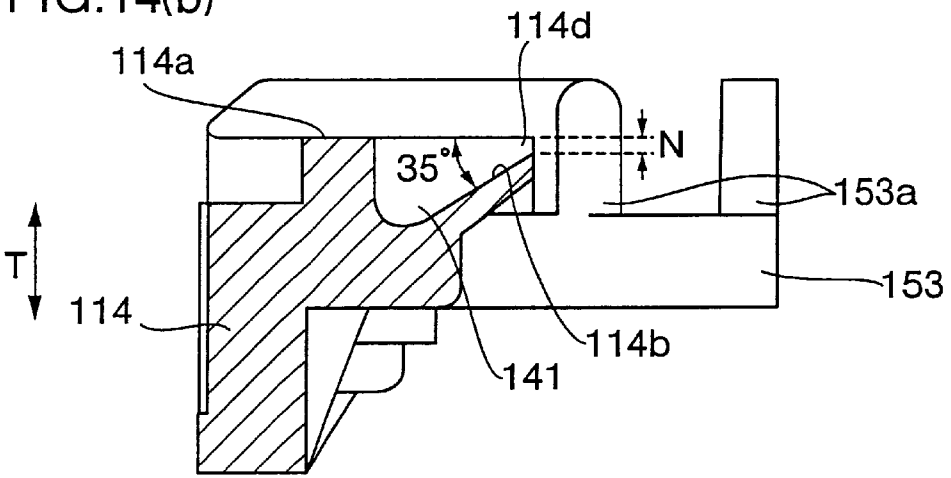
Figure 15:
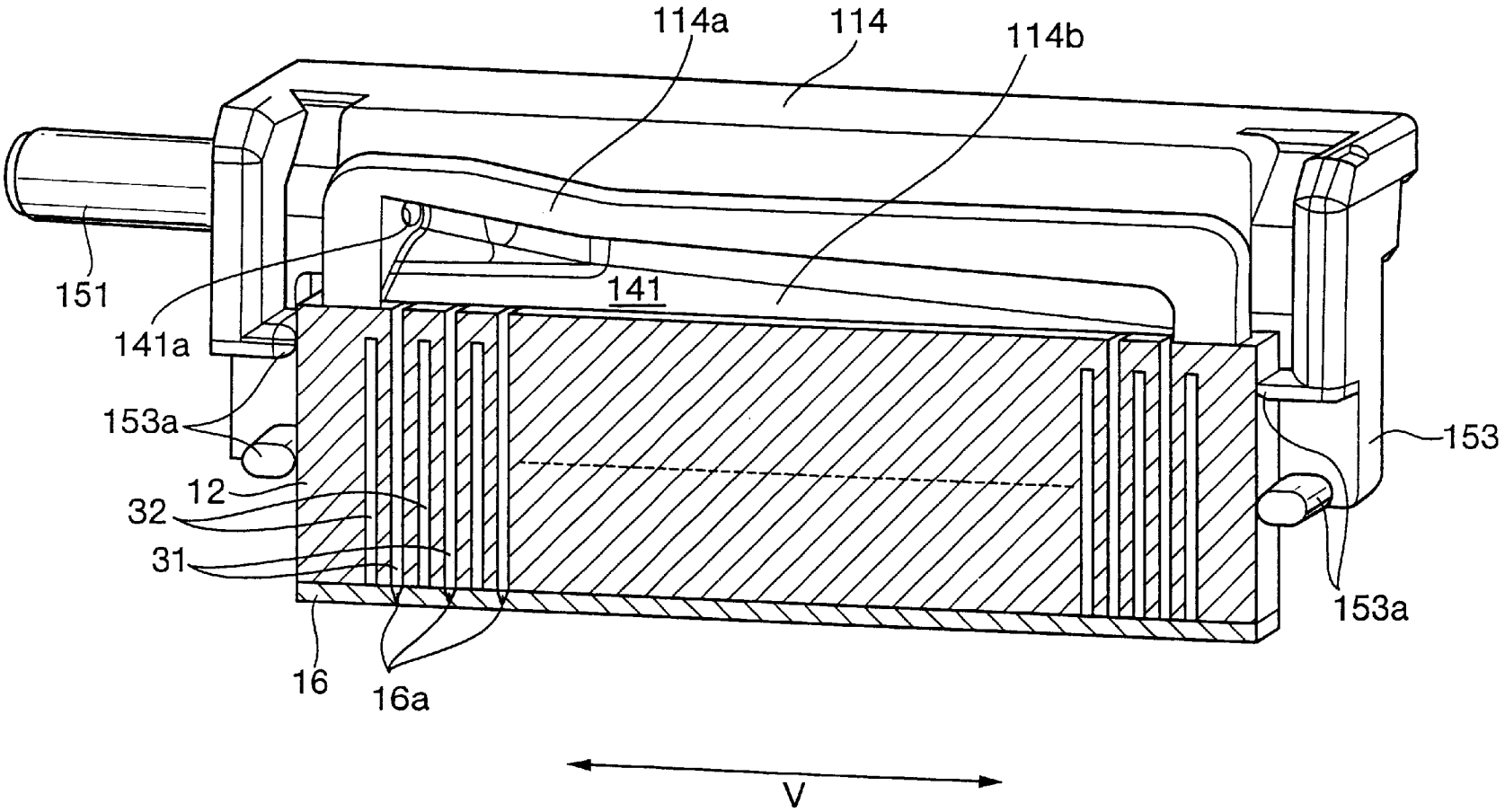
FIG. 15 is a perspective view of the manifold attached to a substrate of the ink jet head.
Figure 16A:
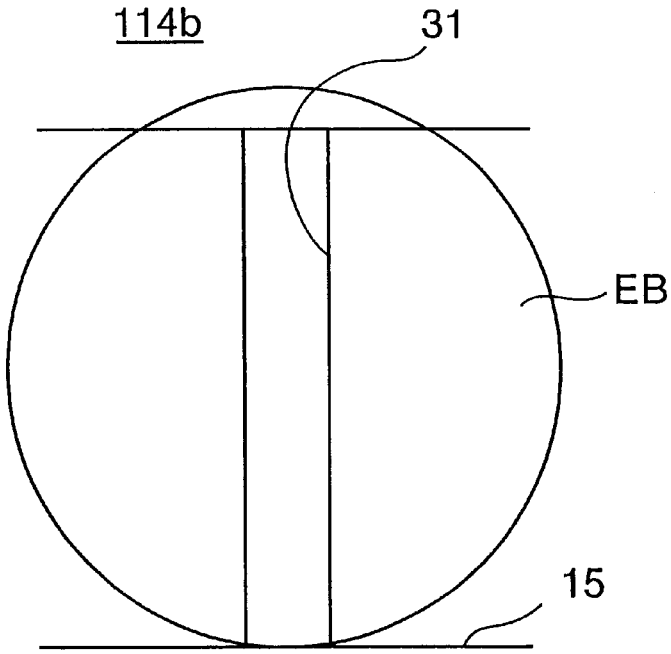
FIG. 16(*a*) is a plan view showing an ink channel and an air bubble.
Figure 16B:
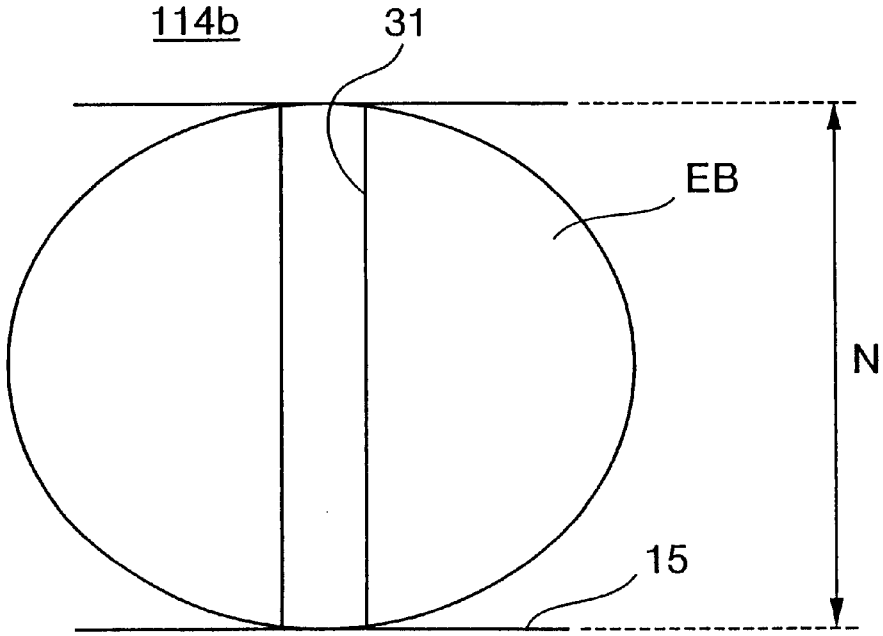
Figure 17A:
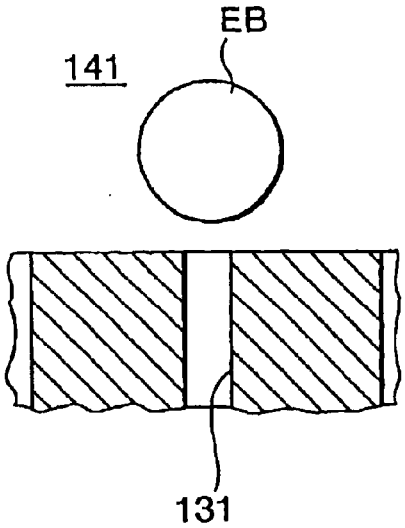
FIG. 17(*a*) is a cross-sectional view showing an air bubble and an ink channel of a conventional ink jet head taken along a line XVIIa—XVIIa of FIG. 17(*a*')
Figure 17A:
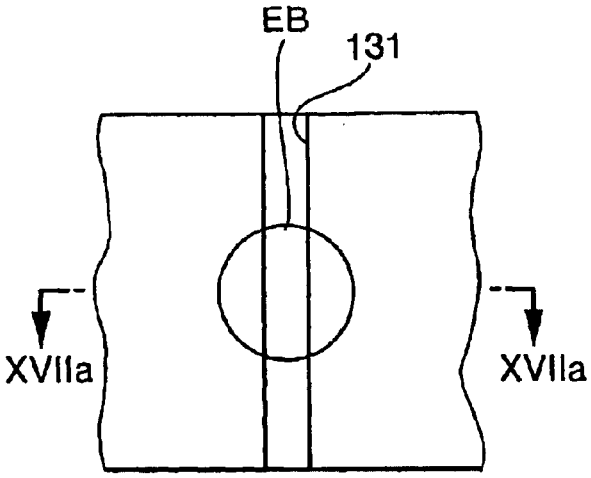
Figure 17B:
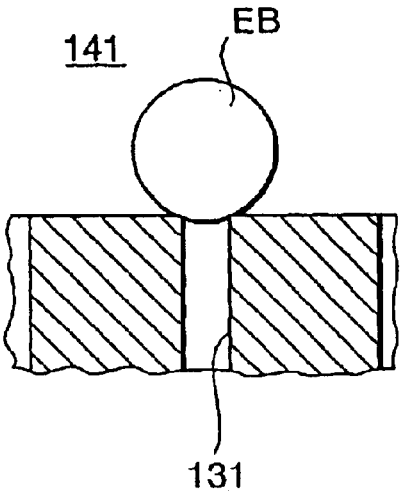
RELATED ART FIG.17(b)
Figure 17B:
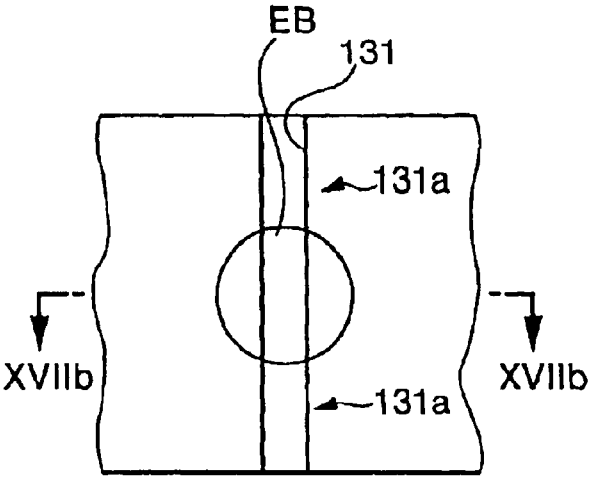
RELATED ART FIG.17(b)

As shown in FIGS. 13 to 15, the manifold 114 has an attach surface 114*a* at which the manifold 114 is attached to the plate member 15. The attach surface 114*a* is formed with a groove defining an ink supply channel 141. The ink supply channel 141 extends in the direction V. The ink supply channel 141 has a taper surface 114*b* that slants at an angle with respect to the attach surface 114*a*. It is favorable that the angle be between 10 degrees and 60 degrees, and more favorable that the angle be between 30 degrees and 40 degrees. In the present embodiment, the angle it set to 35 degrees.

As shown in FIG. 14(*b*), an edge of the taper surface 114*b* is positioned below the attach surface 114*a* by a distance N in the direction T. With this configuration, an outlet opening 114*d* that fluidly connects the ink supply channel 141 and the ink channels 31 is formed between the ink supply channel 141 and the ink channels 31. That is, the outlet opening 114*d* has a height N in the direction T and an elongated length in the direction V. The height N is equal to the length N of the ink channel 31 (FIG. 4).

As shown in FIG. 14(*a*), an ink supply hole 141*a* is formed at one end of the ink supply channel 141. The manifold 114 has a connection portion 151 protruding upward in the direction V from the upper end of the manifold 114. The connection portion 151 has a hollow inside. One end of the connection portion 151 is fluidly connected to the ink supply hole 141*a*, and the other end is fluidly connected to the cartridge 509 via a tube (not shown), so ink can be supplied from the cartridge 509 to the ink supply channel 141 via the tube, the connection portion 151, and the ink supply hole 141*a*.

The manifold 114 also has a pair of engage members 153 protruding forward from the upper and lower end portions of the manifold 114. Each engage member 153 includes a pair of protrusions 153*a*. As shown in FIG. 15, the pairs of protrusions 153*a* engage the upper and lower end of the substrate 12 so as to sandwich the substrate 12 therebetween.

It should be noted that the connection portion 151 and the engage members 153 are integrally formed with the manifold 114 from a resin. Therefore, these components can be produced in a simple manner. It is desirable that the engage members 153 be formed such that a distance between the pair of engage members 153 is the same as the length of the substrate 12 in the direction V. However, some dimensional error is inevitable to occur during manufacture of the ink let head 700. Therefore, as shown in FIG. 15, in order to absorb such an error, the lengthwise direction of the ink supply channel 141 is set slightly greater than the distance between the upper most ink channel 31 and the lower most ink channel 31 in the direction V. Further, the distance between the pair of engage members 153 is set slightly greater than the length of the substrate 12. With this configuration, production processes of the ink jet head 700 is simplified.

The manifold 114 is attached to the substrate 12 and the plate member 15 in the following manner. That is, either one of the engage members 153 is used as a positional reference. The engage member 153 in attached to the corresponding upper or lower end of the substrate 12. At the same time, a front portion 114*c* of the manifold 114 is attached to the rear portion of the substrate 12. Then, the attach surface 114*a* is brought into contact with the plate member 15. It should be noted that portions of the substrate 12 to be fixedly attached to the plate member 15 are indicated by hashing in FIG. 15.

Next, functions and effects of the present embodiment will be described. It is supposed that ink supplied from the cartridge 509 to the ink supply channel 141 contains an air bubble EB shown in FIG. 16(*a*). The air bubble EB has a diameter greater than the length N of the ink channels 31, and stays between the taper surface 114*b* and the plate member 15. When the ink in the ink supply channel 141 flows into the ink channels 31 during the purging or flushing operation, the air bubble EB is pulled toward the ink channels 31. Because the depth of the ink supply channel 141 decreases with proximity to the ink channels 31 as shown in FIGS. 13 and 14(*b*), the air bubble gradually changes its form into an elongated shape. That its, the air bubble spreads along the longitudinal length of the ink supply channel 141 while thinning its diameter. At the some time, because flowing speed of the air inside the ink supply channel 141 increases toward the ink channel 31 because of the taper surface 114*b*, such ink flow also functions to pun the air bubble EB toward the ink channels 31. Then, the diameter of the air bubble EB eventually becomes equal to the length N of the ink channels 31. Therefore, the air bubble is smoothly introduced into the ink channels 31 and ejected through the nozzles 16*a*.

As described above, because the taper surface 114*b* slants at the angle of 35 degrees with respect to the attach surface 114*a*, the taper surface 114*b* reliably deforms an outer shape of an air bubble, thereby enabling ejection of the air bubble out of the ink jet head 700. In contrast to this, if the angle is smaller than 10, then air bubbles may remain at positions next to the taper surface 114*b* away from the outlet opening 114*d*. Also, if the angle to greater than 60 degrees, then air bubbles may remain on the taper surface 114*b*. In either case, a taper surface with such a too-small or too-large angle will not be able to reliably deform the outer shape of the air bubbles, and the air bubbles may not reliably be removed during the purging or flushing operation.

Also, according to the present embodiment, the ink supply channel 141 having the taper surface 114*b* has a simple configuration compared with the ink supply channel 41 of the first embodiment that is formed with the plurality of minute inlet members 42. Also, in the first embodiment, the manifold 13, 14 should be attached to the substrate 11, 12 with precise positional relationship so that the each opening 45 comes into fluid communication with respective ink channel 31. However, according to the second embodiment, the positional relationship between the ink supply channel 141 and the ink channels 31 can be somewhat imprecise as described above. Therefore, production processes will be simplified, and production costs can be reliably lowered.

It should be noted that in the above-described embodiments, each substrate 11, 12 is formed with a channel row including a plurality of ink channels 31. The channel rows of the substrates 11 and 12 are positioned close to each other. Each ink supply channel 41, 141 is formed along the channel row. In such a configuration, the ink supply channel 41, 141 cannot be formed to have substantially a large cross-sectional area. Therefore, the ink supply channel 41, 141 does not have a large volume sufficient for letting air bubbles stay inside for a long period of time without providing adverse influence on ink ejection. However, the above-described configurations can smoothly and easily remove air bubbles during purging and flushing operations. Therefore, although the ink supply channel 41, 141 do not have a large volume, proper ink ejection is possible.

While the invention has been described in detail with reference to specific embodiments thereof, it would be apparent to those skilled in the art that various changes and modifications may be made therein without departing from the spirit of the invention.

For example, the above-described embodiments described the present invention applied to an ink jet head including a piezoelectric element. However, the present invention can be applied to different types of ink jet head, such as a thermal ink jet head including a thermal element.

Also, the above-described ink jet heads 600, 700 are formed with a pair of nozzle rove each including a plurality of nozzles 16*a* so as to eject two different colors of ink. However, an ink jet head that is formed with only one nozzle row and that ejects only a single color of ink can be used. Alternatively, an ink jet head formed with more than two nozzle rows for ejecting more than two different colors of ink can be used. In this case, the ink jet head needs to include more than two substrates.

Although the substrate 11, 12 is formed with both the ink channels 31 and the dummy channels 32 in the above-described embodiments, the substrate 11, 12 can be formed with only the ink channels 31, but not the dummy channels 32.

Further, the ink jet head 600, 700 is mounted on the carriage 504 so as to reciprocally move along the guide rod 501. However, the present invention can be also applied to a line printer wherein an ink jet head is fixed to a predetermine position in an unmovable condition.

In the embodiment described above, the ink jet heads 600 are mounted on the carriage 504 such that the nozzle plate 16 faces frontward and the ink supply hole 22 is located at a bottom portion. However, the ink jet heads 600 can be mounted at a slant angle of 45 degrees with respect to the color ink jet printer 1 so that the nozzle plate 16 faces downward and the substrates 11, 12 locate above the nozzle plate 16.

What to claimed is:

1. An ink jet head used in an image forming device, comprising:

an actuator formed with ink channels defining a channel row extending in a first direction, each ink channel extending in a second direction perpendicular to the first direction; and a manifold attached to the actuator, the manifold being formed with a supply channel fluidly connected to the ink channels, the supply channel having a width in a third direction perpendicular to both the first direction and the second direction, the width decreasing with proximity toward the ink channels in order to facilitate a flow of an air bubble from the supply channel into the ink channel by deforming the air bubble.

2. The ink jet head according to claim 1, wherein the supply channel has at least two opposing surfaces, one of the two opposing surfaces of the supply channel being a taper surface such that a distance in the third direction between the two opposing surfaces decreases with proximity to the ink channels.

3. The inkjet head according to claim 2, wherein the taper surface has an angle of between 10 degrees and 60 degrees with respect to another one of the two opposing surfaces.

4. The ink jet head according to claim 2, wherein the taper surface has an angle of between 30 degrees and 40 degrees with respect to another one of the two opposing surfaces.

5. The ink jet head according to claim 2, wherein the actuator includes a substrate having a first substrate surface and a second substrate surface, the first substrate surface being formed with a plurality of grooves; and the manifold includes a plate member and a manifold member, the plate member having a first plate surface and a second plate surface, the first plate surface being attached to the first substrate surface, thereby defining the plurality of ink channels the manifold member having a first manifold surface and a second manifold surface, the first manifold surface being formed with a groove and attached to the first plate surface, thereby defining the supply channel, the second manifold surface being attached to the second substrate surface, the supply channel has an opening edge opened to the second substrate surface, the opening edge having a length in the first direction, and wherein the channel row has a length in the first direction that is smaller than the length of the opening edge.

6. The ink jet head according to claim 5, wherein the substrate has an outer surface, and the manifold includes an engage member that engages the outer surface of the substrate, thereby positioning the opening side portion of the supply channel so as to confront the channel row of the substrate.

7. An ink jet printer comprising:

the ink jet head of claim 1; and a recovery mechanism that performs at least one of a purging operation and a flushing operation for removing an air bubble from the ink in the supply channel, wherein the supply channel facilitates a flow of the air bubble into the ink channel during the at least one of the purging operation and the flushing operation by deforming the air bubble.

8. The ink jet printer according to claim 7, wherein the supply channel has at least two opposing surfaces, one of the two opposing surfaces of the supply channel being a taper surface such that a distance in the third direction between the two opposing surfaces decreases with proximity to the ink channels.

9. The ink jet printer according to claim 8, wherein the taper surface has an angle of between 10 degrees and 60 degrees with respect to another one of the two opposing surfaces.

10. The ink jet printer according to claim 8, wherein the taper surface has an angle of between 30 degrees and 40 degrees with respect to another one of the two opposing surfaces.

11. The ink jet printer according to claim 8, wherein the actuator includes a substrate having a first substrate surface and a second substrate surface, the first substrate surface being formed with a plurality of grooves; and the manifold includes a plate member and a manifold member, the plate member having a first plate surface and a second plate surface, the first plate surface being attached to the first substrate surface, thereby defining the plurality of ink channels the manifold member having a first manifold surface and a second manifold surface, the first manifold surface being formed with a groove and attached to the first plate surface, thereby defining the supply channel, the second manifold surface being attached to the second substrate surface, the supply channel has an opening edge opened at the second substrate surface, the opening edge having a length in the first direction, and wherein the channel row has a length in the first direction that is smaller than the length of the opening edge.

12. The ink jet printer according to claim 11, wherein the substrate has an outer surface, and the manifold includes an engage member that engages the outer surface of the substrate, thereby positioning the opening side portion of the supply channel so as to confront the channel row of the substrate.

13. The ink jet head according to claim 1, wherein ink and the air bubble in the supply channel are directed into the ink channel while flowing in the first direction.

* * * * *